US010784577B2

(12) United States Patent
Wu et al.

(10) Patent No.: US 10,784,577 B2
(45) Date of Patent: Sep. 22, 2020

(54) DUAL-BAND ANTENNA MODULE

(71) Applicant: PEGATRON CORPORATION, Taipei (TW)

(72) Inventors: Jia-Fong Wu, Taipei (TW); An-Shyi Liu, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 17 days.

(21) Appl. No.: 16/299,816

(22) Filed: Mar. 12, 2019

(65) Prior Publication Data

US 2019/0296435 A1 Sep. 26, 2019

(30) Foreign Application Priority Data

Mar. 26, 2018 (TW) ..... 107110309 A

(51) Int. Cl.
*H01Q 5/10* (2015.01)
*H01Q 5/30* (2015.01)
(Continued)

(52) U.S. Cl.
CPC ..... *H01Q 5/10* (2015.01); *H01Q 1/38* (2013.01); *H01Q 3/24* (2013.01); *H01Q 5/30* (2015.01);
(Continued)

(58) Field of Classification Search
CPC ..... H01Q 5/10; H01Q 5/30; H01Q 5/371; H01Q 5/385; H01Q 5/49; H01Q 1/38;
(Continued)

(56) References Cited

U.S. PATENT DOCUMENTS 7,696,946 B2 4/2010 Shtrom
9,263,798 B1 2/2016 Piazza et al.
(Continued)

FOREIGN PATENT DOCUMENTS

JP 2001345633 A 12/2001
JP 2013026915 A 2/2013
(Continued)

OTHER PUBLICATIONS

European Search Report based on corresponding Application No. 19162493A-1205; dated Aug. 28, 2019.

*Primary Examiner* — Wei (Victor) Y Chan
(74) *Attorney, Agent, or Firm* — Muncy, Geissler, Olds & Lowe, P.C.

(57) ABSTRACT

A dual-band antenna module includes a substrate, a dual-band omnidirectional antenna, a low-frequency reflection module and a high-frequency reflection module. The dual-band omnidirectional antenna is disposed perpendicular to the substrate and is used for resonating to generate a first radio-frequency signal with a first frequency and a second radio-frequency signal with a second frequency. The low-frequency reflection module includes three low-frequency reflection units used for reflecting the first radio-frequency signal with the first frequency according to different low-frequency directional control signals. The high-frequency reflection module includes three high-frequency reflection units used for reflecting the second radio-frequency signal with the second frequency according to different high-frequency directional control signals. The low-frequency reflection units of the low-frequency reflection module and the high-frequency reflection units of the high-frequency reflection module are disposed on the substrate and are disposed around the dual-band omnidirectional antenna.

16 Claims, 4 Drawing Sheets

(51) Int. Cl.

| | |
|---|---|
| ***H01Q 1/38*** | (2006.01) |
| ***H01Q 15/00*** | (2006.01) |
| ***H01Q 15/14*** | (2006.01) |
| ***H01Q 15/16*** | (2006.01) |
| ***H01Q 9/32*** | (2006.01) |
| ***H01Q 5/385*** | (2015.01) |
| ***H01Q 21/20*** | (2006.01) |
| ***H01Q 25/00*** | (2006.01) |
| ***H01Q 3/24*** | (2006.01) |
| ***H01Q 19/17*** | (2006.01) |
| ***H01Q 21/30*** | (2006.01) |
| ***H01Q 9/18*** | (2006.01) |
| ***H01Q 5/371*** | (2015.01) |
| ***H01Q 19/10*** | (2006.01) |
| ***H01Q 5/49*** | (2015.01) |

(52) U.S. Cl.
CPC ..... *H01Q 5/371* (2015.01); *H01Q 5/385* (2015.01); *H01Q 5/49* (2015.01); *H01Q 9/18* (2013.01); *H01Q 9/32* (2013.01); *H01Q 15/0013* (2013.01); *H01Q 15/14* (2013.01); *H01Q 15/148* (2013.01); *H01Q 15/16* (2013.01); *H01Q 19/106* (2013.01); *H01Q 19/17* (2013.01); *H01Q 21/205* (2013.01); *H01Q 21/30* (2013.01); *H01Q 25/00* (2013.01)

(58) Field of Classification Search
CPC .. H01Q 3/24; H01Q 9/18; H01Q 9/32; H01Q 15/0013; H01Q 15/14; H01Q 15/148; H01Q 15/16; H01Q 19/106; H01Q 19/17; H01Q 21/205; H01Q 21/30; H01Q 25/00
USPC ..... 343/781 C, 772, 786, 781 P, 781 R, 797, 343/807, 909
See application file for complete search history.

(56) References Cited

U.S. PATENT DOCUMENTS

| | | | |
|---|---|---|---|
| 9,711,866 | B1 | 7/2017 | Doane et al. |
| 2004/0027304 | A1 | 2/2004 | Chiang et al. |
| 2011/0274146 | A1 | 11/2011 | Huang et al. |
| 2016/0302081 | A1 | 10/2016 | Liu et al. |
| 2017/0271748 | A1 | 9/2017 | Ku et al. |
| 2020/0076479 | A1* | 3/2020 | Rodriguez-Cano ..... H01Q 7/00 |

FOREIGN PATENT DOCUMENTS

| | | | |
|---|---|---|---|
| KR | 100911438 | B1 | 8/2009 |
| KR | 100958846 | | 5/2010 |
| KR | 101390168 | | 5/2014 |
| KR | 101524528 | B1 | 6/2015 |
| KR | 20180012855 | A | 2/2018 |
| TW | 200638603 | A | 11/2006 |
| TW | 201145677 | A | 12/2011 |
| TW | 201705614 | A | 2/2017 |
| WO | WO2006025248 | A1 | 3/2006 |

* cited by examiner

DUAL-BAND ANTENNA MODULE

CROSS REFERENCE TO RELATED APPLICATIONS

This Non-provisional application claims priority under 35 U.S.C. § 119(a) on Patent Application No(s). 107110309 filed in Taiwan, Republic of China on Mar. 26, 2018, the entire contents of which are hereby incorporated by reference.

BACKGROUND

Technology Field

The present invention relates to a dual-band antenna module and particularly relates to a dual-band antenna module capable of avoiding mutual interference between signals using two frequency bands.

Description of the Related Art

As the needs of users for network communication increase, electronic products often need to support network transmission protocols of different standards, and therefore, different antenna modules are often required to correspond to different types of network signals. For examples, the electronic products need to support wireless communications such as third-generation mobile telecommunication technology (3G), Bluetooth and wireless fidelity (Wi-Fi); and because the frequency bands of all wireless communications are different, different antennas are required to receive and transmit signals.

However, as the users have higher and higher requirements for the portability of the electronic products, the electronic products are also required to be lightweight and thin, so that the electronic products with increasingly complicated functions are difficult to provide a large amount of space for accommodating antennas. Under strict space limitation, the design and arrangement of the antennas become more difficult. In the prior art, although the dual-band antenna can resonate to generate signals of different frequency bands in a smaller space to solve the problem of insufficient space, during practical use, in order to avoid mutual interference of the signals of different frequency bands, it is difficult to willfully control the directivity of the signals of different frequency bands, resulting in inconvenience in use.

SUMMARY

One embodiment of the present invention provides a dual-band antenna module, and the dual-band antenna module comprises a substrate, a dual-band omnidirectional antenna, a low-frequency reflection module and a high-frequency reflection module.

The dual-band omnidirectional antenna has a feed-in end disposed on the substrate, and the dual-band omnidirectional antenna is disposed perpendicular to the substrate and is used for resonating to generate a first radio-frequency signal with a first frequency and a second radio-frequency signal with a second frequency, wherein the second frequency is higher than the first frequency.

The low-frequency reflection module is disposed on the substrate and is used for selectively reflecting the first radio-frequency signal with the first frequency when the dual-band omnidirectional antenna operates in a directional mode. The low-frequency reflection module includes a first low-frequency reflection unit, a second low-frequency reflection unit and a third low-frequency reflection unit. The first low-frequency reflection unit is activated according to a first low-frequency directional control signal to reflect the first radio-frequency signal with the first frequency. The second low-frequency reflection unit is activated according to a second low-frequency directional control signal to reflect the first radio-frequency signal with the first frequency. The third low-frequency reflection unit is activated according to a third low-frequency directional control signal to reflect the first radio-frequency signal with the first frequency.

The high-frequency reflection module is disposed on the substrate and is used for selectively reflecting the second radio-frequency signal with the second frequency when the dual-band omnidirectional antenna operates in the directional mode. The high-frequency reflection module comprises a first high-frequency reflection unit, a second high-frequency reflection unit and a third high-frequency reflection unit. The first high-frequency reflection unit is activated according to a first high-frequency directional control signal to reflect the second radio-frequency signal with the second frequency. The second high-frequency reflection unit is activated according to a second high-frequency directional control signal to reflect the second radio-frequency signal with the second frequency. The third high-frequency reflection unit is activated according to a third high-frequency directional control signal to reflect the second radio-frequency signal with the second frequency.

The first low-frequency reflection unit, the second low-frequency reflection unit, the third low-frequency reflection unit, the first high-frequency reflection unit, the second high-frequency reflection unit and the third high-frequency reflection unit are disposed around the dual-band omnidirectional antenna.

DETAILED DESCRIPTION

Figure 1:
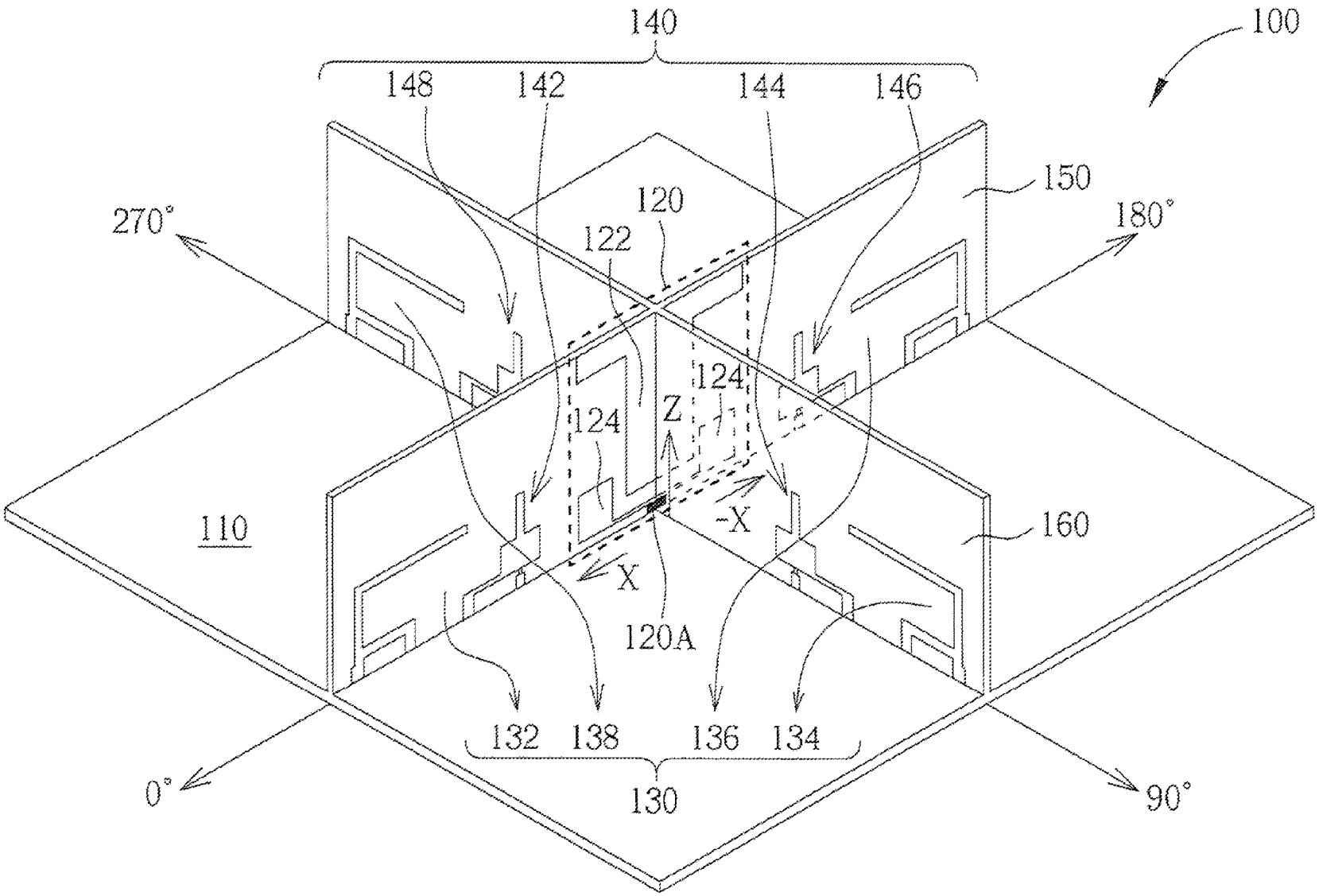
FIG. 1 is a schematic diagram of a dual-band antenna module according to one embodiment of the present invention.

FIG. 1 is a schematic diagram of a dual-band antenna module 100 according to one embodiment of the present invention. The dual-band antenna module 100 includes a substrate 110, a dual-band omnidirectional antenna 120, a low-frequency reflection module 130 and a high-frequency reflection module 140.

The dual-band omnidirectional antenna 120 is capable of resonating to generate a first radio-frequency signal with a first frequency and a second radio-frequency signal with a second frequency, and transmitting the first and second radio-frequency signals in an omnidirectional mode. The second frequency and the first frequency occupy different radio frequency bands, and for example, the second frequency can be higher than the first frequency. For example, in wireless fidelity (Wi-Fi), the second frequency may be within 5 GHz frequency band, and the first frequency may be within 2.4 GHz frequency band.

In FIG. 1, the feed-in end 120A of the dual-band omnidirectional antenna 120 is disposed on the substrate 110, and the dual-band omnidirectional antenna 120 is disposed perpendicular to the substrate 110 so as to generate resonance in perpendicular polarization. In some embodiments of the present invention, the dual-band omnidirectional antenna 120 may include a T-shaped support arm 122 and a pair of extension support arms 124. The bottom thin end of the T-shaped support arm 122 is coupled to the feed-in end 120A, and the T-shaped support arm 122 extends from the bottom thin end towards the normal direction of a plane of the substrate 110 (namely the Z-axis direction in FIG. 1) so as to stand on the substrate 110 and is capable of resonating to generate the first radio-frequency signal with the first frequency.

The extension support arms 124 are also coupled to the feed-in end 120A and symmetrically disposed at two sides of the bottom of the T-shaped support arm 122. For example, the extension support arms 124 are disposed in the +X direction and the −X direction of the T-shaped support arm 122 and are capable of resonating to generate the second radio-frequency signal with the second frequency.

Although the dual-band omnidirectional antenna 120 transmits the signals in an omnidirectional mode, the dual-band antenna module 100 is capable of controlling the directivity of the signals of different frequency bands through the low-frequency reflection module 130 and the high-frequency reflection module 140.

In FIG. 1, the low-frequency reflection module 130 may include a first low-frequency reflection unit 132, a second low-frequency reflection unit 134, a third low-frequency reflection unit 136 and a fourth low-frequency reflection unit 138. The first low-frequency reflection unit 132 is activated according to a first low-frequency directional control signal to reflect the first radio-frequency signal with the first frequency. The second low-frequency reflection unit 134 is activated according to a second low-frequency directional control signal to reflect the first radio-frequency signal with the first frequency. The third low-frequency reflection unit 136 is activated according to a third low-frequency directional control signal to reflect the first radio-frequency signal with the first frequency. The fourth low-frequency reflection unit 138 is activated according to a fourth low-frequency directional control signal to reflect the first radio-frequency signal with the first frequency.

In addition, the first low-frequency reflection unit 132, the second low-frequency reflection unit 134, the third low-frequency reflection unit 136 and the fourth low-frequency reflection unit 138 could be disposed on the substrate 110 around the dual-band omnidirectional antenna 120. Because the first low-frequency reflection unit 132, the second low-frequency reflection unit 134, the third low-frequency reflection unit 136 and the fourth low-frequency reflection unit 138 are positioned in different directions of the dual-band omnidirectional antenna 120, when the first low-frequency reflection unit 132, the second low-frequency reflection unit 134, the third low-frequency reflection unit 136 or the fourth low-frequency reflection unit 138 is activated and reflects the first radio-frequency signal with the first frequency, the intensity of the first radio-frequency signal with the first frequency in that direction could be reduced. Therefore, by activating the specific low-frequency reflection unit according to the low-frequency directional control signal, the directivity of the first radio-frequency signal transmitted by the dual-band antenna module 100 is effectively adjusted.

For example, in FIG. 1, the first low-frequency reflection unit 132 is disposed at a first side of the dual-band omnidirectional antenna 120, the second low-frequency reflection unit 134 is disposed at a second side of the dual-band omnidirectional antenna 120, the third low-frequency reflection unit 136 is disposed at a third side of the dual-band omnidirectional antenna 120, and the fourth low-frequency reflection unit 138 is disposed at a fourth side of the dual-band omnidirectional antenna 120. In addition, an included angle between the first side and the second side, an included angle between the second side and the third side, an included angle between the third side and the fourth side and an included angle between the fourth side and the first side are substantially identical, which are 90 degrees, for example. For example, in FIG. 1, the first side of the dual-band omnidirectional antenna 120 may be at the 0-degree direction of the dual-band omnidirectional antenna 120, the second side of the dual-band omnidirectional antenna 120 may be at the 90-degree direction of the dual-band omnidirectional antenna 120, the third side of the dual-band omnidirectional antenna 120 may be at the 180-degree direction of the dual-band omnidirectional antenna 120, and the fourth side of the dual-band omnidirectional antenna 120 may be at the 270-degree direction of the dual-band omnidirectional antenna 120.

In such cases, when the first low-frequency reflection unit 132 and the second low-frequency reflection unit 134 are activated to reflect the first radio-frequency signal with the first frequency and the third low-frequency reflection unit 136 but the fourth low-frequency reflection unit 138 are not activated, the first radio-frequency signal transmitted by the dual-band antenna module 100 points to a direction between the third side and the fourth side of the dual-band omnidirectional antenna 120, that is, at the 225-degree direction, which is between 180 degrees and 270 degrees. In other words, if the first radio-frequency signal transmitted by the dual-band antenna module 100 wants to point to a specific direction, the low-frequency reflection unit in the opposite direction of the specific direction may be activated through the corresponding low-frequency directional control signal, so that the intensity of the radio-frequency signal in the opposite direction may be weakened, and the dual-band antenna module 100 is capable of transmitting the first radio-frequency signal, pointing to the specific direction.

Similarly, the high-frequency reflection module 140 may include a first high-frequency reflection unit 142, a second high-frequency reflection unit 144, a third high-frequency reflection unit 146 and a fourth high-frequency reflection unit 148. The first high-frequency reflection unit 142 is activated according to a first high-frequency directional control signal to reflect the second radio-frequency signal with the second frequency, the second high-frequency reflection unit 144 is activated according to a second high-frequency directional control signal to reflect the second radio-frequency signal with the second frequency, the third high-frequency reflection unit 146 is activated according to a third high-frequency directional control signal to reflect the second radio-frequency signal with the second frequency, and the fourth high-frequency reflection unit 148 is activated according to a fourth high-frequency directional control signal to reflect the second radio-frequency signal with the second frequency. In addition, the first high-frequency reflection unit 142, the second high-frequency reflection unit 144, the third high-frequency reflection unit 146 and the fourth high-frequency reflection unit 148 could be disposed on the substrate 110 around the dual-band omnidirectional antenna 120.

Because the first high-frequency reflection unit 142, the second high-frequency reflection unit 144, the third high-frequency reflection unit 146 and the fourth high-frequency reflection unit 148 are positioned in the respective directions of the dual-band omnidirectional antenna 120, when the first high-frequency reflection unit 142, the second high-frequency reflection unit 144, the third high-frequency reflection unit 146 and the fourth high-frequency reflection unit 148 is activated and reflects the second radio-frequency signal with the second frequency, the intensity of the radio-frequency signal with the second frequency in a certain direction could be reduced. Therefore, by activating the specific high-frequency reflection unit according to the high-frequency directional control signal, the directivity of the second radio-frequency signal transmitted by the dual-band antenna module 100 is effectively adjusted.

For example, in FIG. 1, the first high-frequency reflection unit 142 is disposed at the first side of the dual-band omnidirectional antenna 120 the same side as the first low-frequency reflection unit 132; the second high-frequency reflection unit 144 is disposed at the second side of the dual-band omnidirectional antenna 120 the same side as the second low-frequency reflection unit 134; the third high-frequency reflection unit 146 is disposed at the third side of the dual-band omnidirectional antenna 120 the same side as the third low-frequency reflection unit 136; and the fourth high-frequency reflection unit 148 is disposed at the fourth side of the dual-band omnidirectional antenna 120 the same side as the fourth low-frequency reflection unit 138.

In such cases, when the first high-frequency reflection unit 142 and the second high-frequency reflection unit 144 are activated to reflect the second radio-frequency signal with the second frequency, but the third high-frequency reflection unit 146 and the fourth high-frequency reflection unit 148 are not activated, the second radio-frequency signal transmitted by the dual-band antenna module 100 points to a direction between the third side and the fourth side of the dual-band omnidirectional antenna 120.

In other words, if it is desired that the second radio-frequency signal transmitted by the dual-band antenna module 100 points to a specific direction, the high-frequency reflection unit in the opposite direction of the specific direction may be activated through the corresponding high-frequency directional control signal, so that the intensity of the second radio-frequency signal in the opposite direction may be weakened, and the dual-band antenna module 100 is capable of transmitting the second radio-frequency signal in a mode of pointing to the specific direction.

In addition, because the low-frequency reflection module 130 and the high-frequency reflection module 140 may operate independently, in some embodiments, when the dual-band antenna module 100 operates in the directional mode, the first radio-frequency signal and the second radio-frequency signal which are transmitted by the dual-band antenna module 100 is capable of simultaneously pointing to different directions according to the needs of a user. For example, when the first low-frequency reflection unit 132 and the second low-frequency reflection unit 134 are activated but the third low-frequency reflection unit 136 and the fourth low-frequency reflection unit 138 are not activated, the first radio-frequency signal transmitted by the dual-band antenna module 100 points to the 225-degree direction between the third side and the fourth side of the dual-band omnidirectional antenna 120. Meanwhile, if the third high-frequency reflection unit 146 and the fourth high-frequency reflection unit 148 are activated but the first high-frequency reflection unit 142 and the second high-frequency reflection unit 144 are not activated, the second radio-frequency signal transmitted by the dual-band antenna module 100 points to the 45-degree direction between the first side and the second side of the dual-band omnidirectional antenna 120. In other words, the first radio-frequency signal and the second radio-frequency signal point to different directions. In other embodiments of the present invention, the first radio-frequency signal and the second radio-frequency signal which are transmitted by the dual-band antenna module 100 is capable of simultaneously pointing to the identical direction according to the needs of the user.

In the embodiment of FIG. 1, the dual-band antenna module 100 may include a first printed circuit board 150 and a second printed circuit board 160. The first printed circuit board 150 and the second printed circuit board 160 are locked by crossing each other and stand on the substrate 110 so that the dual-band omnidirectional antenna 120 could be formed on the first printed circuit board 150, and is positioned at the cross point of the first printed circuit board 150 and the second printed circuit board 160 and is disposed perpendicular to the substrate 110. In other words, the T-shaped support arm 122 and the pair of extension support arms 124 of the dual-band omnidirectional antenna 120 both could be disposed on the first printed circuit board 150.

In addition, the first low-frequency reflection unit 132, the first high-frequency reflection unit 142, the third low-frequency reflection unit 136 and the third high-frequency reflection unit 146 may be formed on the first printed circuit board 150, and the second low-frequency reflection unit 134, the second high-frequency reflection unit 144, the fourth low-frequency reflection unit 138 and the fourth high-frequency reflection unit 148 may be formed on the second printed circuit board 160.

Figure 2:
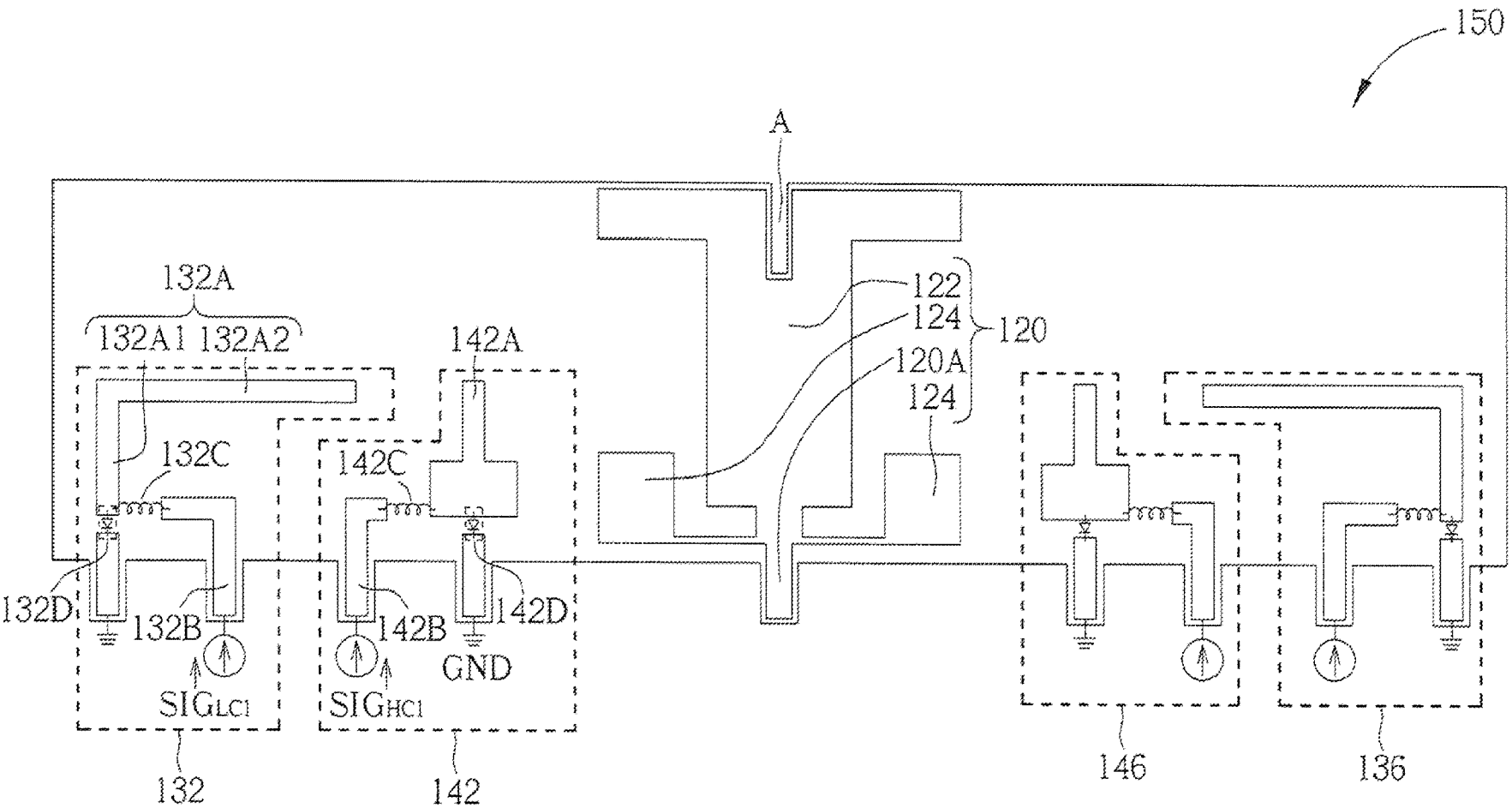
FIG. 2 is a schematic diagram of a first printed circuit board of the dual-band antenna module in FIG. 1.
Figure 3:
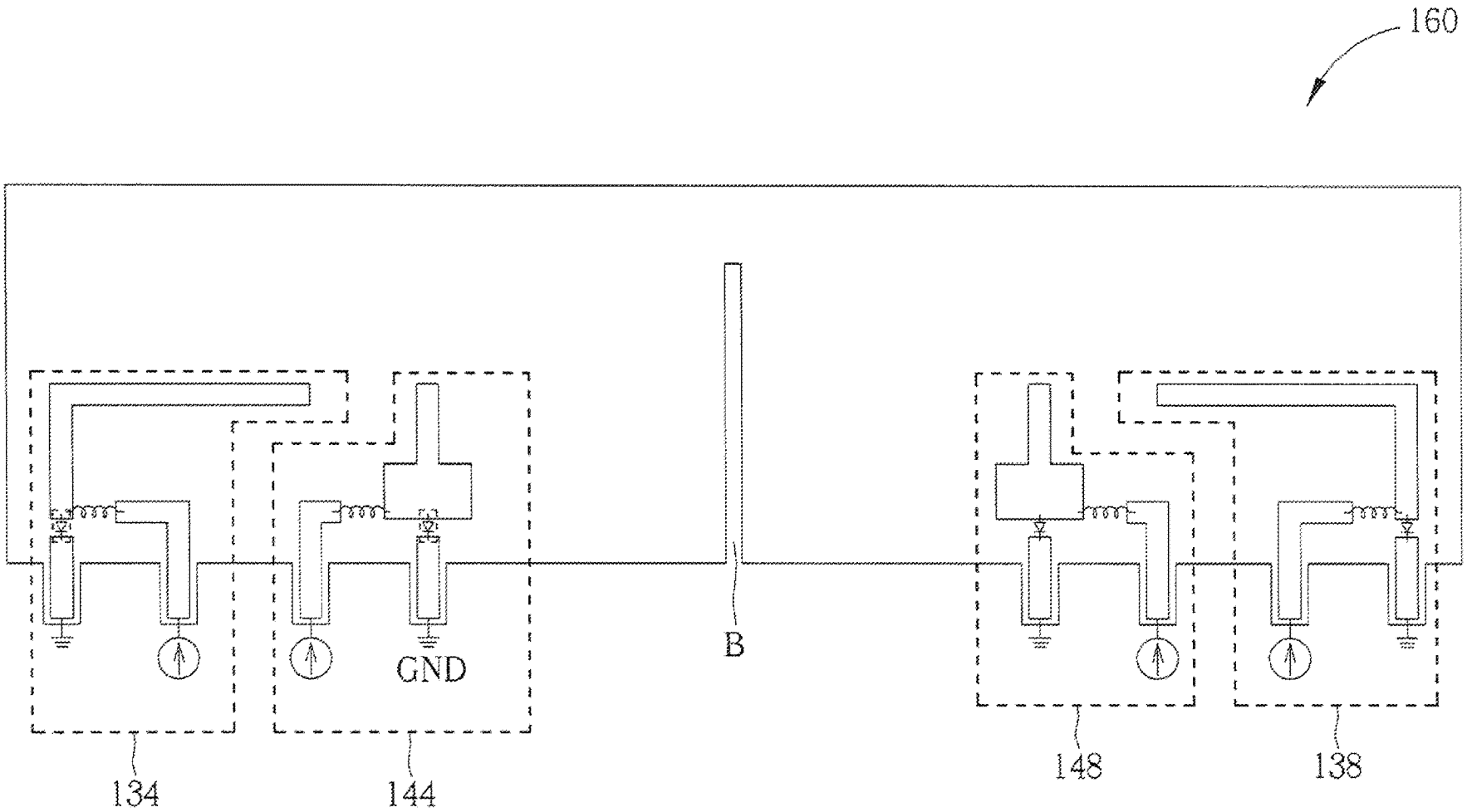
FIG. 3 is a schematic diagram of a second printed circuit board of the dual-band antenna module in FIG. 1.

FIG. 2 is a schematic diagram of the first printed circuit board 150 according to one embodiment of the present invention, and FIG. 3 is a schematic diagram of the second printed circuit board 160 according to one embodiment of the present invention. In the embodiments of FIG. 2 and FIG. 3, mortise and tenon structures A and B are disposed in the middle positions of the first printed circuit board 150 and the second printed circuit board 160, so that the first printed circuit board 150 and the second printed circuit board 160 cross and lock each other to form the dual-band antenna module 100 shown in FIG. 1.

In FIG. 2, the first high-frequency reflection unit 142 includes a convex reflection element 142A, a first bias end 142B, a first inductor 142C and a first diode 142D. The first bias end 142B is capable of receiving a first high-frequency directional control signal $SIG_{HC1}$. The first inductor 142C has a first end and a second end. The first end of the first inductor 142C is coupled to the first bias end 142B to receive the first high-frequency directional control signal $SIG_{HC1}$, and the second end of the first inductor 142C is coupled to the convex reflection element 142A. The first diode 142D has an anode and a cathode, the anode of the first diode 142D is coupled to the convex reflection element 142A, and the cathode of the first diode 142D is coupled to a ground terminal GND.

When a user intends to activate the first high-frequency reflection unit 142 to reflect the second radio-frequency signal with the second frequency, the corresponding first high-frequency directional control signal $SIG_{HC1}$ is outputted to turn on the first diode 142D. At this moment, a voltage loop is formed between the first bias end 142B and the ground terminal GND, and the convex reflection element 142A is grounded. Thus, the first high-frequency reflection unit 142 is activated to reflect the second radio-frequency signal with the second frequency. In addition, the first inductor 142C prevents an external radio-frequency signal from causing circuit damage through the first bias end 142B, and allows the first high-frequency directional control signal $SIG_{HC1}$ to pass through to turn on or off the first diode 142D.

The first low-frequency reflection unit 132 may include an L-shaped reflection element 132A, a second bias end 132B, a second inductor 132C and a second diode 132D. The second bias end 132B is capable of receiving a first low-frequency directional control signal $SIG_{LC1}$. The second inductor 132C has a first end and a second end, and the first end of the second inductor 132C is coupled to the second bias end 132B to receive the first low-frequency directional control signal $SIG_{LC1}$. The second diode 132D has an anode and a cathode, and the cathode of the second diode 132D is coupled to the ground terminal GND. A short arm 132A1 of the L-shaped reflection element 132A is coupled to the anode of the second diode 132D and the second end of the second inductor 132C and is perpendicular to the substrate 110, and a long arm 132A2 of the L-shaped reflection element 132A is parallel to the substrate 110.

When the user intends to activate the first low-frequency reflection unit 132 to reflect the first radio-frequency signal with the first frequency, the corresponding first low-frequency directional control signal $SIG_{LC1}$ is outputted to turn on the second diode 132D. At this moment, a voltage loop is formed between the second bias end 132B and the ground terminal GND, and the L-shaped reflection element 132A is grounded. Thus, the first low-frequency reflection unit 132 is activated to reflect the first radio-frequency signal with the first frequency. In addition, the second inductor 132C prevents the external radio-frequency signal from causing circuit damage through the second bias end 132B, and allows the first low-frequency directional control signal $SIG_{LC1}$ to pass through to turn on or off the second diode 132D.

In order to effectively reflect the signals, the low-frequency reflection module 130 and the high-frequency reflection module 140 could be disposed in a position corresponding to a quarter of wavelength of the dual-band omnidirectional antenna 120. For example, if the first frequency of the first radio-frequency signal has a center frequency of 2.4 GHz, the distance between the first high-frequency reflection unit 142 and the feed-in end 120A of the dual-band omnidirectional antenna 120 may be between 16 mm and 18 mm, and the distance between the first low-frequency reflection unit 132 and the feed-in end 120A of the dual-band omnidirectional antenna 120 may be between 36 mm and 38 mm. In other words, the first low-frequency reflection unit 132, the second low-frequency reflection unit 134, the third low-frequency reflection unit 136 and the fourth low-frequency reflection unit 138 could be disposed at the outer sides of the first high-frequency reflection unit 142, the second high-frequency reflection unit 144, the third high-frequency reflection unit 146 and the fourth high-frequency reflection unit 148, respectively.

In addition, in order to avoid the influence on the high-frequency signal when the low-frequency reflection module 130 is activated, the height of the low-frequency reflection unit of the low-frequency reflection module 130 may be between 0.09 times and 0.12 times the wavelength of the first radio-frequency signal, thereby preventing the radiation pattern of the high-frequency signal from being blocked when the height is too high, and also avoiding the poor reflection effect when the height is too low. For example, if the first frequency of the first radio-frequency signal has a center frequency of 2.4 GHz, the height of the first low-frequency reflection unit is 10 mm. In other words, the short arm 132A1 of the L-shaped reflection element 132A may extend from the dual-band omnidirectional antenna 120 at a distance of 36 mm towards the Z-axis direction by 10 mm, and the long arm 132A2 of the L-shaped reflection element 132A extends towards the dual-band omnidirectional antenna 120 by 12 mm, along a direction parallel to a plane of the substrate 110.

In embodiments of FIG. 1 to FIG. 3, the first low-frequency reflection unit 132, the second low-frequency reflection unit 134, the third low-frequency reflection unit 136 and the fourth low-frequency reflection unit 138 may have the identical structure, and the first high-frequency reflection unit 142, the second high-frequency reflection unit 144, the third high-frequency reflection unit 146 and the fourth high-frequency reflection unit 148 also may have the identical structure.

In addition, in some embodiments of the present invention, in order to have the dual-band antenna module 100 more accurately adjust the directivity of the transmitted signal, the low-frequency reflection module 130 and the high-frequency reflection module 140 may further include a greater number of low-frequency reflection units and high-frequency reflection units which are disposed around the dual-band omnidirectional antenna 120. Therefore, when a low-frequency reflection unit or a high-frequency reflection unit of the dual-band omnidirectional antenna 120 disposed in a specific direction is activated to reflect the corresponding radio-frequency signal, the radio-frequency signal in the specific direction is reflected, so that the signal transmitted by the dual-band omnidirectional antenna 120 points to the opposite direction of the specific direction.

Figure 4:
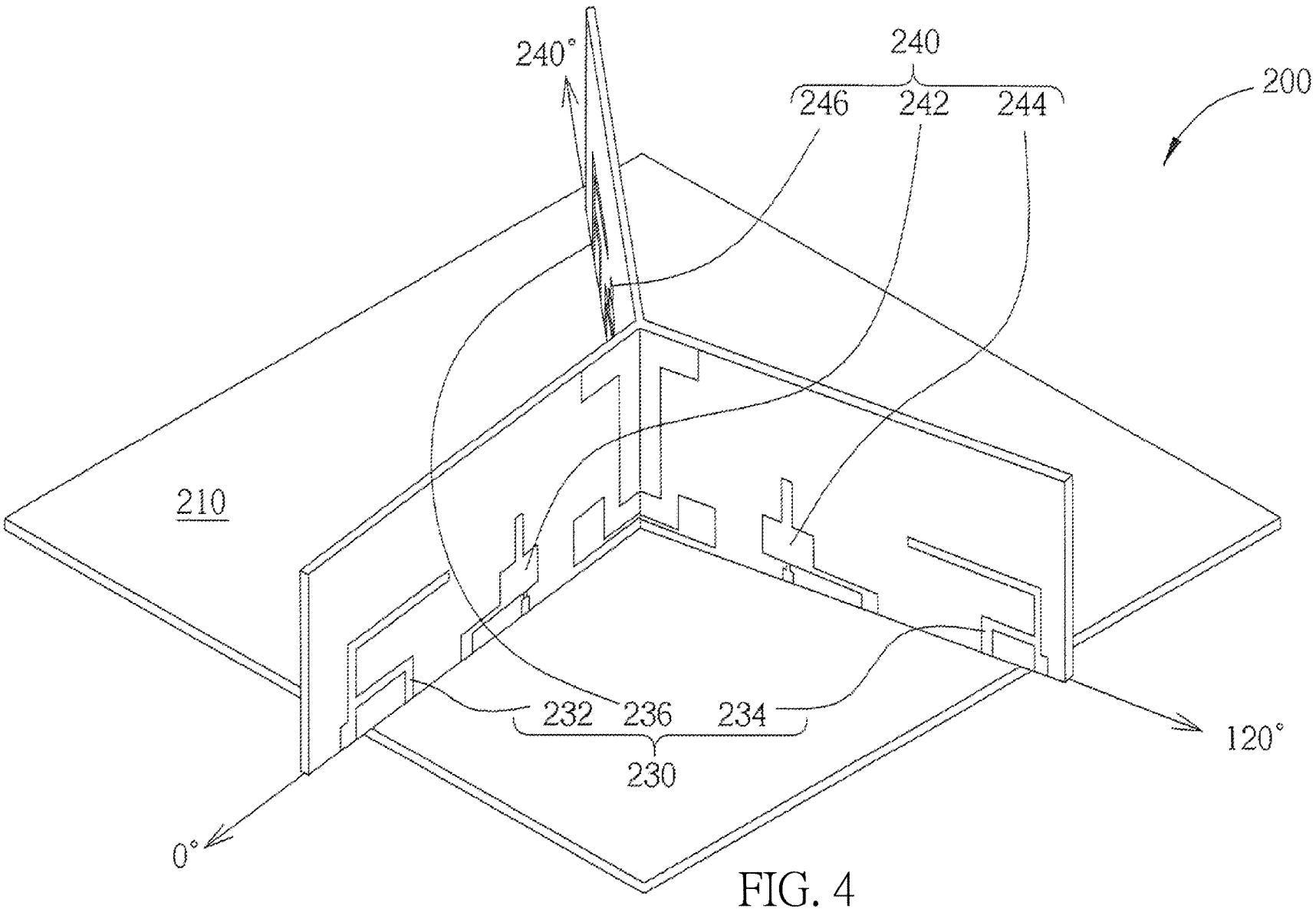
FIG. 4 is a schematic diagram of a dual-band antenna module according to another embodiment of the present invention.

Furthermore, in some embodiments of the present invention, the number of the low-frequency reflection units and the number of the high-frequency reflection units in the low-frequency reflection module 130 and the high-frequency reflection module 140 may be reduced according to the needs of a system. FIG. 4 is a schematic diagram of a dual-band antenna module 200 according to another embodiment of the present invention. The dual-band antenna module 200 and the dual-band antenna module 100 have similar structures and operating principles. The main difference between the dual-band antenna module 200 and the dual-band antenna module 100 is that a low-frequency reflection module 230 of the dual-band antenna module 200 only includes a first low-frequency reflection unit 232, a second low-frequency reflection unit 234 and a third low-frequency reflection unit 236, and a high-frequency reflection module 240 of the dual-band antenna module 200 only includes a first high-frequency reflection unit 242, a second high-frequency reflection unit 244 and a third high-frequency reflection unit 246.

The first low-frequency reflection unit 232, the second low-frequency reflection unit 234, the third low-frequency reflection unit 236, the first high-frequency reflection unit 242, the second high-frequency reflection unit 244 and the third high-frequency reflection unit 246 are disposed on a substrate 210 and are disposed around a dual-band omnidirectional antenna 220.

In FIG. 4, the first low-frequency reflection unit 232 and the first high-frequency reflection unit 242 is disposed at the first side of the dual-band omnidirectional antenna 220, namely the 0-degree direction as shown in FIG. 4; the second low-frequency reflection unit 234 and the second high-frequency reflection unit 244 is disposed at the second side of the dual-band omnidirectional antenna 220, namely the 120-degree direction as shown in FIG. 4; the third low-frequency reflection unit 236 and the third high-frequency reflection unit 246 are disposed at the third side of the dual-band omnidirectional antenna 220, namely the 240-degree direction as shown in FIG. 4. In other words, an included angle between the first side and the second side of the dual-band omnidirectional antenna 220, an included angle between the second side and the third side of the dual-band omnidirectional antenna 220 and an included angle between the third side and the first side of the dual-band omnidirectional antenna 220 are 120 degrees.

In such cases, when the first high-frequency reflection unit 242 and the second high-frequency reflection unit 244 are activated but the third high-frequency reflection unit 246 is not activated, the second radio-frequency signal transmitted by the dual-band antenna module 200 points to the third side of the dual-band omnidirectional antenna 220, namely, the 240-degree direction shown in FIG. 4.

Similarly, when the first low-frequency reflection unit 232 and the second low-frequency reflection unit 234 are activated but the third low-frequency reflection unit 236 is not activated, the first radio-frequency signal transmitted by the dual-band antenna module 200 points to the third side of the dual-band omnidirectional antenna 220, namely, the 240-degree direction shown in FIG. 4.

In other words, the dual-band antenna module 200 is still capable of independently controlling the directivity of the signals of different frequency bands through the low-frequency reflection module 230 and the high-frequency reflection module 240.

In conclusion, the dual-band antenna module provided by the embodiments of the present invention includes the low-frequency reflection module and the high-frequency reflection module. The low-frequency reflection module and the high-frequency reflection module could be disposed around the dual-band omnidirectional antenna and activate the low-frequency reflection unit or the high-frequency reflection unit in a specific direction, which allows the radio-frequency signal transmitted to the specific direction to be reflected, thereby controlling the directivity of the transmitted signal. In addition, because the low-frequency reflection module and the high-frequency reflection module is capable of operating independently, the signals of different frequency bands point to different directions, thereby further increasing the flexibility in use.

The above embodiments are merely preferred embodiments of the present invention, and all changes and modifications made to the patent scope of the present invention should be within the scope of the present invention.

What is claimed is:

1. A dual-band antenna module, comprising:

a substrate;

a dual-band omnidirectional antenna having a feed-in end disposed on the substrate, wherein the dual-band omnidirectional antenna is disposed perpendicular to the substrate and resonates to generate a first radio-frequency signal with a first frequency and a second radio-frequency signal with a second frequency, wherein the second frequency is higher than the first frequency;

a low-frequency reflection module disposed on the substrate for selectively reflecting the first radio-frequency signal with the first frequency when the dual-band omnidirectional antenna operates in a directional mode, wherein the low-frequency reflection module comprises:

a first low-frequency reflection unit, the first low-frequency reflection unit being activated according to a first low-frequency directional control signal to reflect the first radio-frequency signal with the first frequency;

a second low-frequency reflection unit, the second low-frequency reflection unit being activated according to a second low-frequency directional control signal to reflect the first radio-frequency signal with the first frequency; and a third low-frequency reflection unit, the third low-frequency reflection unit being activated according to a third low-frequency directional control signal to reflect the first radio-frequency signal with the first frequency; and a high-frequency reflection module disposed on the substrate for selectively reflecting the second radio-frequency signal with the second frequency when the dual-band omnidirectional antenna operates in the directional mode, wherein the high-frequency reflection module comprises:

a first high-frequency reflection unit, the first high-frequency reflection unit being activated according to a first high-frequency directional control signal to reflect the second radio-frequency signal with the second frequency;

a second high-frequency reflection unit, the second high-frequency reflection unit being activated according to a second high-frequency directional control signal to reflect the second radio-frequency signal with the second frequency; and a third high-frequency reflection unit, the third high-frequency reflection unit being activated according to a third high-frequency directional control signal to reflect the second radio-frequency signal with the second frequency.

2. The dual-band antenna module according to claim 1, wherein the first low-frequency reflection unit, the second low-frequency reflection unit, the third low-frequency reflection unit, the first high-frequency reflection unit, the second high-frequency reflection unit and the third high-frequency reflection unit are disposed around the dual-band omnidirectional antenna;

the first low-frequency reflection unit and the first high-frequency reflection unit are disposed at a first side of the dual-band omnidirectional antenna;

the second low-frequency reflection unit and the second high-frequency reflection unit are disposed at a second side of the dual-band omnidirectional antenna;

the third low-frequency reflection unit and the third high-frequency reflection unit are disposed at a third side of the dual-band omnidirectional antenna; and an included angle between the first side and the second side, an included angle between the second side and the third side, and an included angle between the third side and the first side are identical.

3. The dual-band antenna module according to claim 2, wherein when the first low-frequency reflection unit and the second low-frequency reflection unit are activated and the third low-frequency reflection unit is not activated, the first radio-frequency signal transmitted by the dual-band antenna module points to the third side.

4. The dual-band antenna module according to claim 2, wherein when the first high-frequency reflection unit and the second high-frequency reflection unit are activated and the third high-frequency reflection unit is not activated, the second radio-frequency signal transmitted by the dual-band antenna module points to the third side.

5. The dual-band antenna module according to claim 1, wherein when the dual-band antenna module operates in the directional mode, the first radio-frequency signal and the second radio-frequency signal transmitted by the dual-band antenna module point to different directions so as to reduce interference between the first radio-frequency signal and the second radio-frequency signal.

6. The dual-band antenna module according to claim 1, wherein the low-frequency reflection module further comprises a fourth low-frequency reflection unit used for reflecting the first radio-frequency signal with the first frequency according to a fourth low-frequency directional control signal;

the high-frequency reflection module further comprises a fourth high-frequency reflection unit used for reflecting the second radio-frequency signal with the second frequency according to a fourth high-frequency directional control signal; and the first low-frequency reflection unit, the second low-frequency reflection unit, the third low-frequency reflection unit, the fourth low-frequency reflection unit, the first high-frequency reflection unit, the second high-frequency reflection unit, the third high-frequency reflection unit and the fourth high-frequency reflection unit are disposed on the substrate around the dual-band omnidirectional antenna.

7. The dual-band antenna module according to claim 6, wherein the first low-frequency reflection unit and the first high-frequency reflection unit are disposed at a first side of the dual-band omnidirectional antenna;

the second low-frequency reflection unit and the second high-frequency reflection unit are disposed at a second side of the dual-band omnidirectional antenna;

the third low-frequency reflection unit and the third high-frequency reflection unit are disposed at a third side of the dual-band omnidirectional antenna;

the fourth low-frequency reflection unit and the fourth high-frequency reflection unit are disposed at a fourth side of the dual-band omnidirectional antenna; and an included angle between the first side and the second side, an included angle between the second side and the third side, an included angle between the third side and the fourth side, and an included angle between the fourth side and the first side are identical.

8. The dual-band antenna module according to claim 7, wherein when the first low-frequency reflection unit and the second low-frequency reflection unit are activated and the third low-frequency reflection unit and the fourth low-frequency reflection unit are not activated, the first radio-frequency signal transmitted by the dual-band antenna module points to a direction between the third side and the fourth side.

9. The dual-band antenna module according to claim 7, wherein when the first high-frequency reflection unit and the second high-frequency reflection unit are activated and the third high-frequency reflection unit and the fourth high-frequency reflection unit are not activated, the second radio-frequency signal transmitted by the dual-band antenna module points to a direction between the third side and the fourth side.

10. The dual-band antenna module according to claim 6, further comprising a first printed circuit board and a second printed circuit board, wherein the first printed circuit board and the second printed circuit board are locked and crossed with each other and stand on the substrate;

the dual-band omnidirectional antenna is formed on the first printed circuit board, positioned at a cross point of the first printed circuit board and the second printed circuit board, and disposed perpendicular to the substrate;

the first low-frequency reflection unit, the first high-frequency reflection unit, the third low-frequency reflection unit and the third high-frequency reflection unit are formed on the first printed circuit board; and the second low-frequency reflection unit, the second high-frequency reflection unit, the fourth low-frequency reflection unit and the fourth high-frequency reflection unit are formed on the second printed circuit board.

11. The dual-band antenna module according to claim 1, wherein the dual-band omnidirectional antenna comprises:

a T-shaped support arm having a bottom thin end coupled to the feed-in end, and being perpendicular to the substrate and used for transmitting the first radio-frequency signal; and a pair of extension support arms coupled to the feed-in end, and symmetrically disposed at two sides of the bottom of the T-shaped support arm for transmitting the second radio-frequency signal.

12. The dual-band antenna module according to claim 1, wherein the first high-frequency reflection unit comprises:

a convex reflection element;

a first bias end for receiving the first high-frequency directional control signal;

a first inductor having a first end coupled to the first bias end for receiving the first high-frequency directional control signal and a second end coupled to the convex reflection element; and a first diode having an anode coupled to the convex reflection element and a cathode coupled to a ground terminal.

13. The dual-band antenna module according to claim 12, wherein the first low-frequency reflection unit comprises:

a second bias end for receiving the first low-frequency directional control signal;

a second inductor having a first end coupled to the second bias end for receiving the first low-frequency directional control signal and a second end;

a second diode having an anode and a cathode coupled to a ground terminal; and an L-shaped reflection element, wherein a short arm of the L-shaped reflection element is coupled to the anode of the second diode and the second end of the second inductor, and is perpendicular to the substrate while a long arm of the L-shaped reflection element is parallel to the substrate.

14. The dual-band antenna module according to claim 1, wherein the second frequency is within 5 GHz frequency band, and the first frequency is within 2.4 GHz frequency band.

15. The dual-band antenna module according to claim 14, wherein a height of the first low-frequency reflection unit is between 0.09 times and 0.12 times a wavelength of the first radio-frequency signal.

16. The dual-band antenna module according to claim 14, wherein a distance between the first high-frequency reflection unit and the feed-in end of the dual-band omnidirectional antenna is between 16 mm and 18 mm; and a distance between the first low-frequency reflection unit and the feed-in end of the dual-band omnidirectional antenna is between 36 mm and 38 mm.

* * * * *